US005507389A

United States Patent [19]

Syrek

[11] Patent Number: 5,507,389

[45] Date of Patent: Apr. 16, 1996

[54] STACKABLE CONTAINER FOR PREMOISTENED WIPES

[75] Inventor: Gerald M. Syrek, Washingtonville, N.Y.

[73] Assignee: Reckitt & Colman, Inc., United Kingdom

[21] Appl. No.: 373,022

[22] Filed: Jan. 17, 1995

Related U.S. Application Data

[63] Continuation of Ser. No. 156,986, Nov. 23, 1993, Pat. No. 5,392,945, which is a continuation of Ser. No. 931,483, Aug. 19, 1992, abandoned.

[51] Int. Cl.[6] ..... B65D 21/02

[52] U.S. Cl. ..... 206/508; 206/509; 220/4.27; 220/608

[58] Field of Search ..... 206/233, 494, 206/361, 209, 812, 508, 509; 220/339, 354, 605, 608, 4.27, 4.26, 23.6, 23.83, 23.86, 324, 23.4; 446/128, 71, 75, 76

[56] References Cited

U.S. PATENT DOCUMENTS

| | | | |
|---|---|---|---|
| D. 252,977 | 9/1979 | Bayly | D9/10 |
| D. 257,528 | 11/1980 | Cherry | D9/431 |
| D. 283,487 | 4/1986 | Holewinski et al. | D9/341 |
| D. 330,161 | 10/1992 | Schuh | D9/423 |
| D. 336,613 | 6/1993 | Zutler | D9/423 |
| 2,695,645 | 11/1954 | Tupper | 150/0.5 |
| 2,939,603 | 6/1960 | Young | 206/508 |
| 3,374,917 | 3/1968 | Troy | 220/23.4 |
| 3,391,824 | 7/1968 | Wiseman | 220/97 |
| 3,405,858 | 10/1968 | Collie | 229/2.5 |
| 3,458,113 | 7/1969 | Swartzbaugh | 229/44 |
| 3,481,068 | 12/1969 | Paulson | 46/25 |
| 3,524,564 | 8/1970 | Schurman | 220/16 |
| 3,616,943 | 11/1971 | Brink . | |
| 3,640,018 | 2/1972 | Light | 46/29 |
| 3,982,659 | 9/1976 | Ross | 221/63 |
| 4,206,845 | 6/1980 | Christian | 206/508 |
| 4,545,487 | 10/1985 | Asmus | 206/508 |
| 4,621,744 | 11/1986 | Foster | 220/270 |
| 4,624,383 | 11/1986 | Moore | 220/23.6 |
| 4,694,961 | 9/1987 | Menendez | 206/508 |
| 4,703,853 | 11/1987 | Byrns | 206/387 |
| 4,892,220 | 1/1990 | Foos | 220/339 |
| 4,903,453 | 2/1990 | Newsom | 52/648 |
| 4,938,360 | 7/1990 | Wallace | 206/586 |
| 4,989,744 | 2/1991 | Tominaga | 220/94 |
| 5,035,098 | 7/1991 | Newsom | 52/589 |
| 5,035,324 | 7/1991 | Bertrand | 446/75 |
| 5,058,357 | 10/1991 | Newsom | 52/648 |
| 5,131,551 | 7/1992 | Wells | 220/4.23 |
| 5,145,088 | 9/1992 | Goujon | 220/355 |
| 5,219,087 | 6/1993 | Christenson | 220/270 |
| 5,392,945 | 2/1995 | Syrek | 220/608 |

FOREIGN PATENT DOCUMENTS

| | | | |
|---|---|---|---|
| 1290727 | 12/1962 | France | 446/128 |
| 1394391 | 2/1965 | France | 206/508 |
| 1404289 | 5/1965 | France | 220/23.6 |
| 1907662 | 4/1967 | Germany . | |
| 92403 | 9/1972 | Germany . | |
| 2947678 | 7/1980 | Germany . | |
| 3804275 | 8/1989 | Germany . | |
| 3920886 | 1/1991 | Germany . | |
| 589922 | 7/1947 | United Kingdom | 446/124 |

*Primary Examiner*—Stephen J. Castellano
*Attorney, Agent, or Firm*—Millen, White, Zelano & Branigan

[57] ABSTRACT

A stackable container useful for containing premoistened wipes therein includes a bottom having a pair of circular recesses and a lid having a pair of circular projections in alignment with the circular recesses so that the container may stack with similar containers. Each container is twice as long as it is wide so that the containers may stack in a staggered configuration, extending either parallel or perpendicular with respect to one another. The lid of the container is unitary with a rim and pivots with respect to the rim on a living hinge. A raised floor with a gutter therearound is provided at the bottom of the container for supporting a stack of moist wipes, wherein the edges of the lowermost wipes remain immersed in moisture which pools in the gutter in order to keep the stack moist.

7 Claims, 6 Drawing Sheets

STACKABLE CONTAINER FOR PREMOISTENED WIPES

This is a continuation of the application Ser. No. 08/156,986 filed Nov. 23, 1993, now U.S. Pat. No. 5,392,945, which is a continuation of Ser. No. 07/931,483, filed Aug. 19, 1992 now abandoned.

BACKGROUND OF THE INVENTION

1. Field of the Invention

The instant invention relates to interlocking containers. More particularly, the instant invention relates to containers for premoistened wipes, which containers are interlockable when stacked.

2. Background Art

Packages for articles such as moist wipes are available in a number of configurations and vary substantially in size. Generally, these packages are either soft with flexible walls or relatively rigid. The relatively rigid packages are in the form of containers which retain their shape after their contents have been used and then can be used for other purposes.

The prior art includes containers which have interlocking structures. However, the prior art does not include the concept of storing moistened wipes in interlocking containers. Moistened wipes are frequently used in the care of infants and toddlers, which makes it desirable for the packages or containers to have some purpose in addition to containing the wipes. For examples, containers have been marketed which resemble toy animals. As the prior art indicates, containers which can be used as interlocking building blocks can be used as toys which have amusement and educational value for small children. Since when moist wipes are used to care for a child, the wipes are used rather rapidly, it does not take long for a container to empty and need to be replaced by a new container. After a relatively short while, a number of containers can be accumulated, providing a supply of relatively large, discrete structures. To date, having a collection of these containers served no useful purpose. If the container resembled an animal, then one or two animals would be generally enough, and the remaining containers would be disposed of surplus.

The prior art also includes a number of disclosures in which containers have interlocking structures so as to provide for stable storage in warehouses, while in transit, and in retain outlets. With these containers, there is no reason to stack the containers after they have been emptied by the consumer.

SUMMARY OF THE INVENTION

In view of the aforementioned considerations, it is an object of the instant invention to provide a new and improved container, useful for packaging moist wipes, which container interlocks with adjacent similar containers for stacking both prior to and after retail sale.

In view of this and other objects, the instant invention contemplates a stackable container for containing moist wipes wherein the container comprises a substantially rectangular box portion containing the wipes, the box portion having a pair of cylindrical indentations of a selected diameter in the bottom thereof. A rim having an inner periphery and an outer periphery is mounted at the top of the box portion and includes a lid pivoted thereto. The lid has a pair of cylindrical projections extending therefrom which are in axial alignment with the cylindrical indentations in the bottom of the box portion when the lid is closed. The cylindrical projections have a selected diameter which complements that of the cylindrical indentations, whereby the container interlocks with containers of a similar configuration.

DETAILED DESCRIPTION

Figure 1:
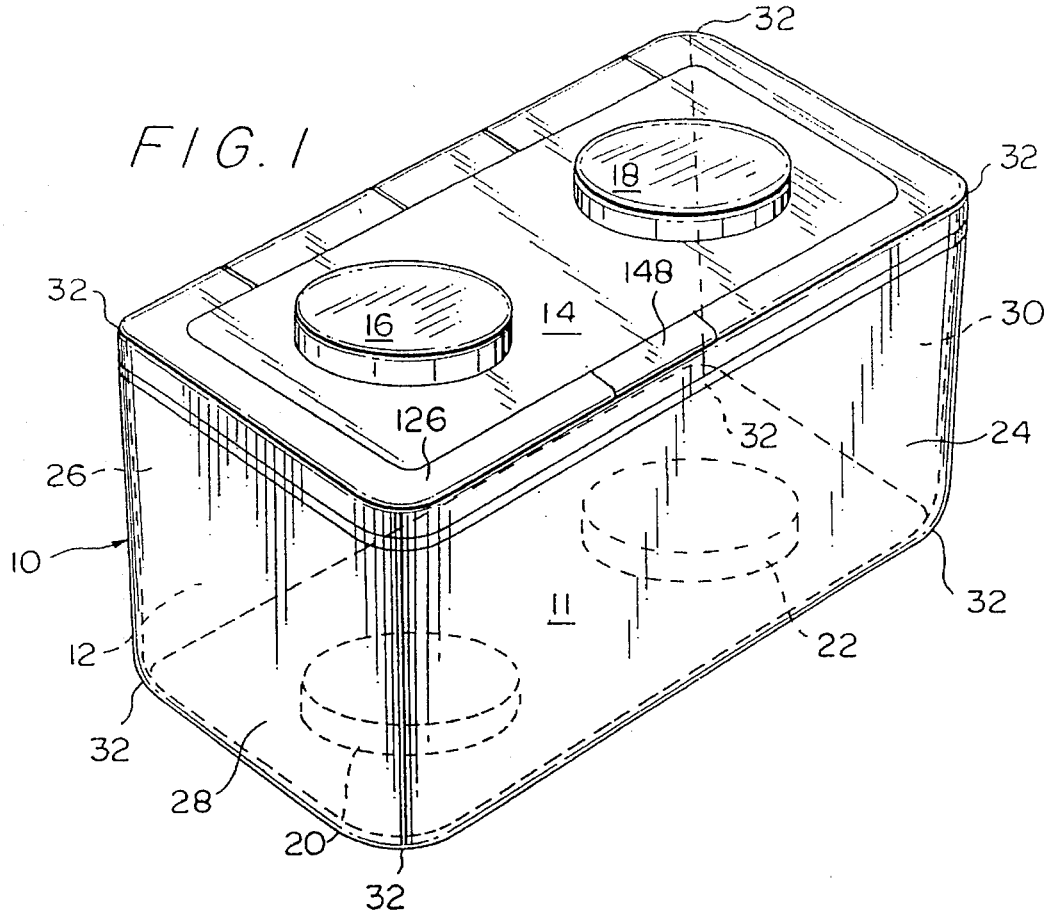
FIG. 1 is a perspective view, partially in phantom, showing a single container configured in accordance with the principles of the instant invention.

Referring now to FIG. 1, there is shown a container 10 having a box portion 11 for containing a stack of premoistened wipes 12 therein which are dispensed from the container after opening a lid 14. The container 10 is substantially rectangular in configuration and includes two first interlockable members in the form of circular projections 16 and 18 projecting from the lid 14 and two second interlockable members in the form of circular recesses 20 and 22 formed at the bottom of the box portion 14, the projections being in axial alignment with the recesses when the lid is closed. The front and rear walls 24 and 26 and the first and second ends 28 and 30 are smooth surfaces upon which labels (not shown) may be placed.

Figure 2:
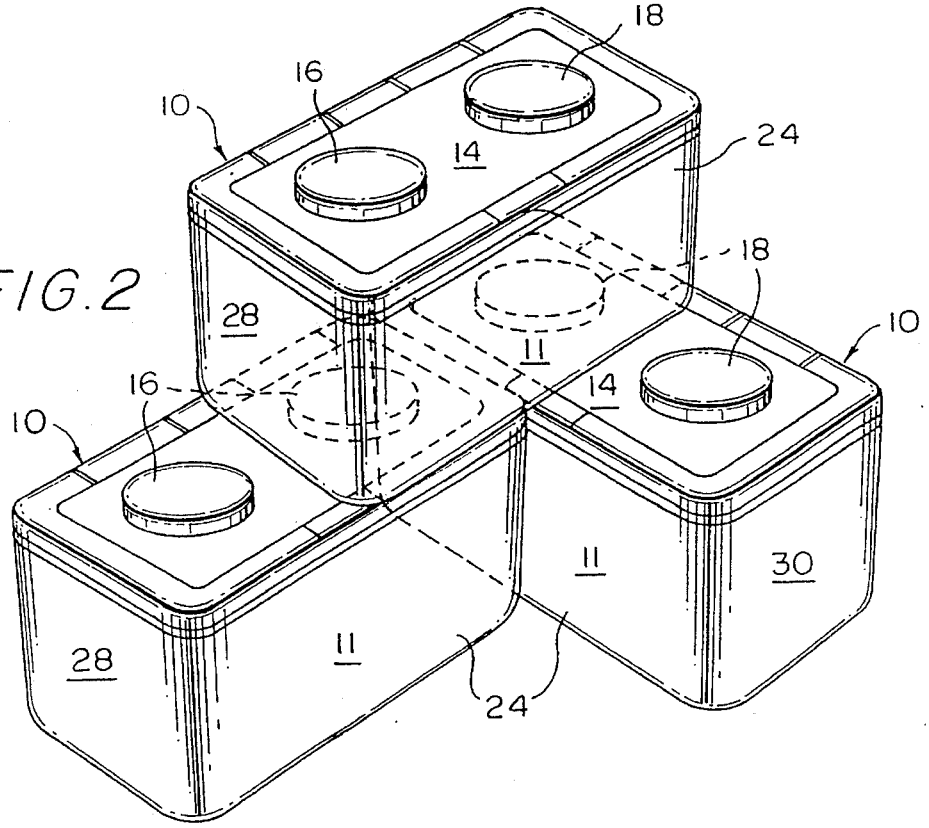
FIG. 2 is a perspective view, with portions in phantom, showing a plurality of the containers of FIG. 1 stacked in interlocking relationship.
Figure 3:
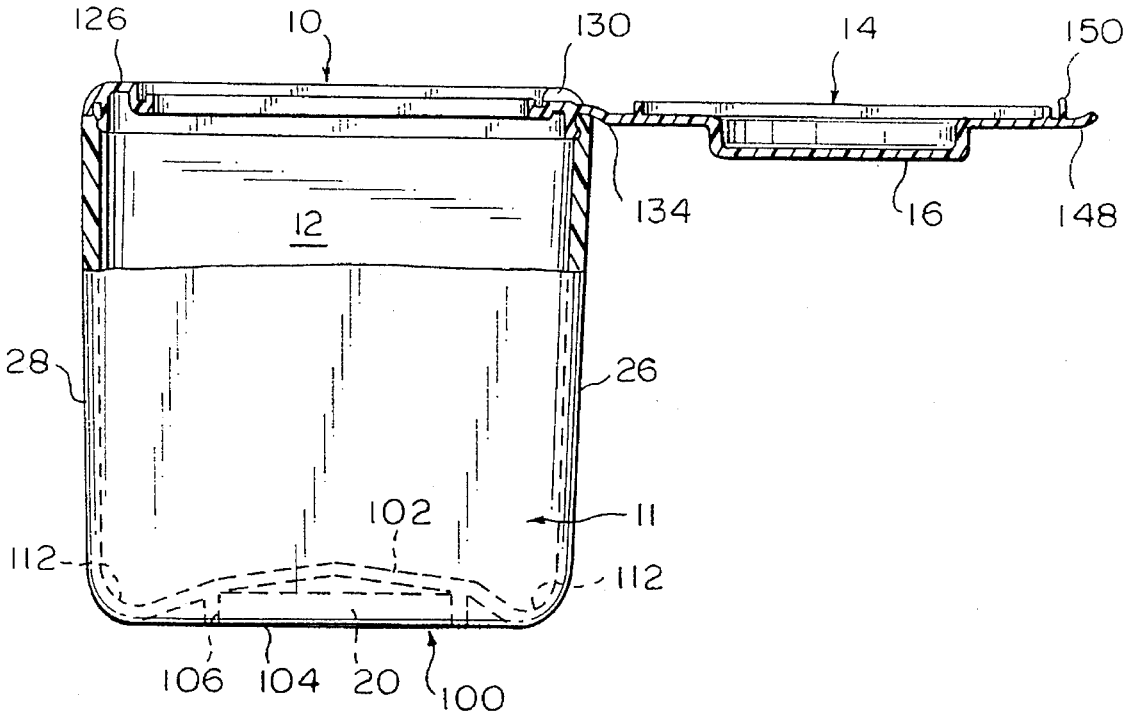
FIG. 3 is an end view of the container of FIG. 1, with portions in phantom.
Figure 4:
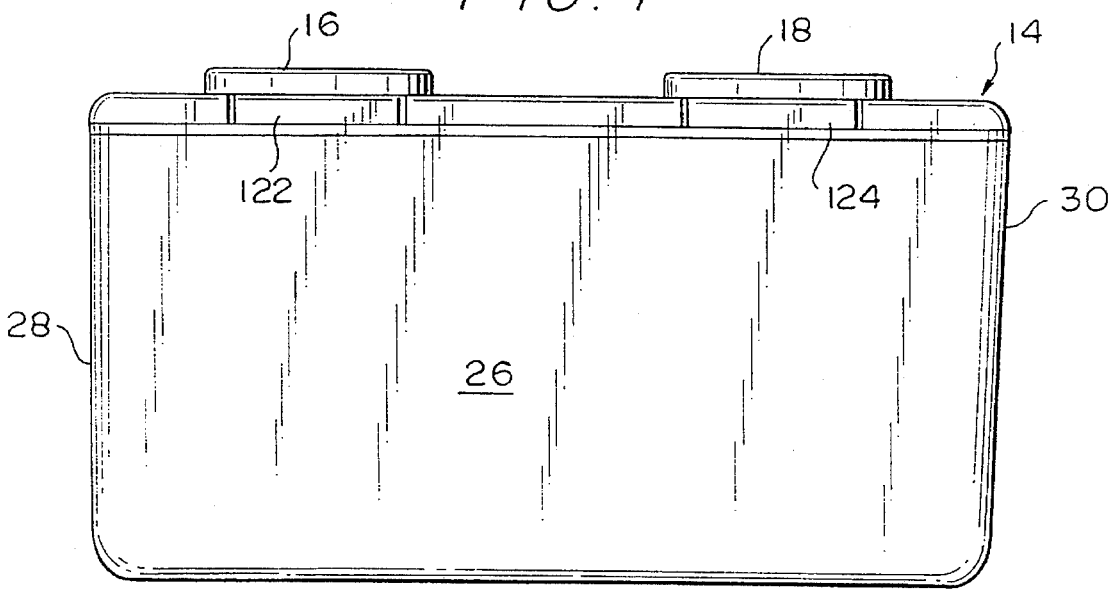
FIG. 4 is a back side view of the container of FIG. 1.

Referring now mainly to FIG. 2, there is shown a plurality of containers 10 stacked, with the projections 16 and 18 of one container received in the recesses 20 and 22 of the container stacked thereon. The containers 10 may stack in a number of different ways. For example, one container 10 may stack on another with the projections 16 and 18 of the bottom container being received in the recesses 20 and 22 of a single top container, or the containers may stack with one container overlapping two containers. The containers may be oriented either parallel or normal to the other containers in the stack, providing a wide variety of stacking arrangements.

When the containers 10 are empty, they are relatively light so that the projections 16 and 18 and recesses 20 and 22 provide a needed stability to stacks of the containers. When a customer has an infant or toddler, the wipes 12 are used at a relatively rapid rate so that the customer is likely to accumulate a substantial number of containers 10 in a relatively short time, providing the customer's child with blocks which are light enough for a child to manipulate while providing a substantial degree of resistance to unstacking when they are stacked due to projections 16 and 18 locking with adjacent recesses 20 and 22. In addition to being relatively light in weight, the containers 10 have rounded corners 32, which minimize risk of injury.

Referring now mainly to FIGS. 3–6, it is seen that the box portion 11 of the container 10 has a bottom, designated generally by the numeral 100, which includes a domed floor 102 upon which the stack 12 of premoistened wipes rests. The floor 102 is raised from the absolute bottom portion 104 by a distance sufficient to accommodate the depth of the recesses 20 and 22. The recesses 20 and 22 are formed by circular walls or rings 106 (FIG. 3) and 108 (FIG. 6), respectively, which have a diameter complementing or perhaps slightly larger than the cylindrical projections 16 and 18 of an adjacent lower block. The rings 106 and 108 define the openings 16 and 18 as each having a depth no greater than the depth of the indentation in the bottom of the box portion defining the domed floor 102.

Figure 5:
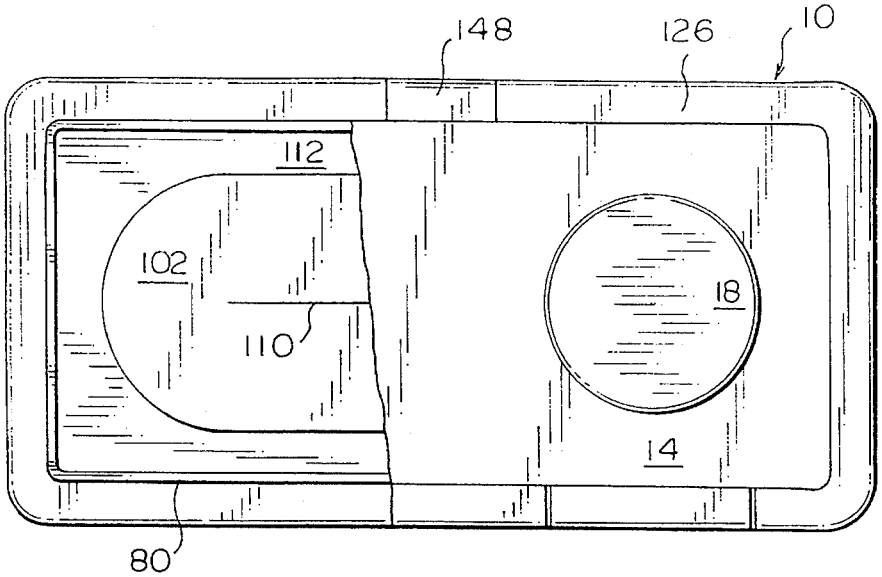
FIG. 5 is a top view of the container of FIG. 1, with portions broken away.
Figure 6:
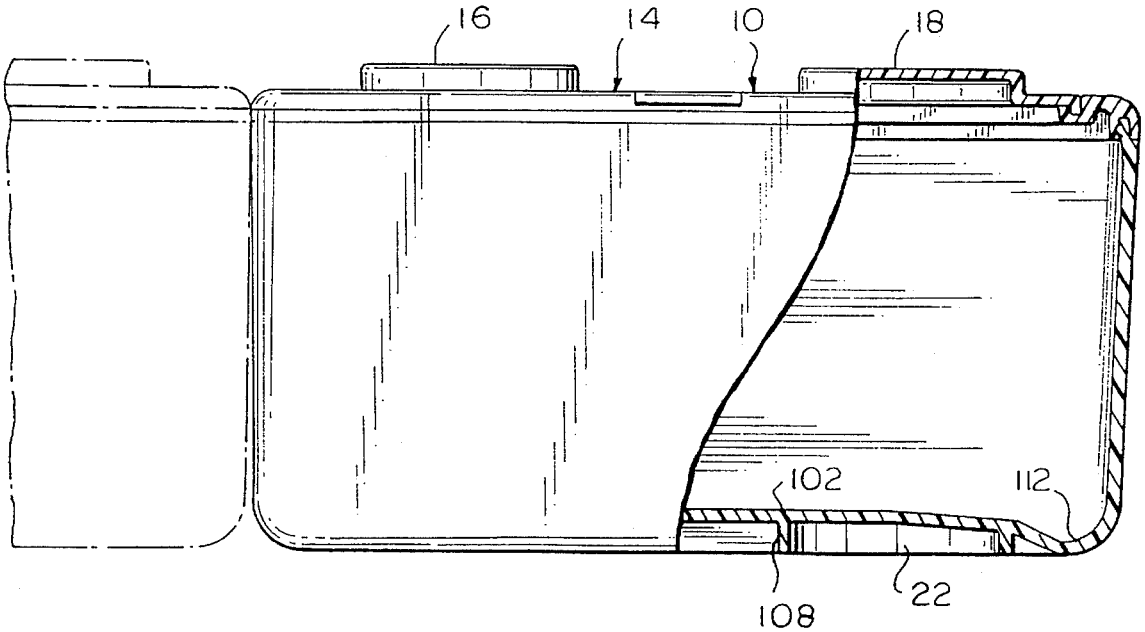
FIG. 6 is a front side view of the container of FIG. 1, with portions broken away and with an adjacent container shown in phantom.

As is seen in FIG. 5, the floor 102 appears as an oblong platform projecting into the box portion 11. The floor 102 has a peak 110. Surrounding the raised floor 102 is a peripheral gutter 112 in which moisture accumulates. Since the bottom wipes in the stack 12 drape over the raised floor 102, the edges of the bottom wipes will remain immersed in any moisture which pools in the gutter 112 so as to wick the moisture and keep the stack of premoistened wipes wet.

Figure 7:
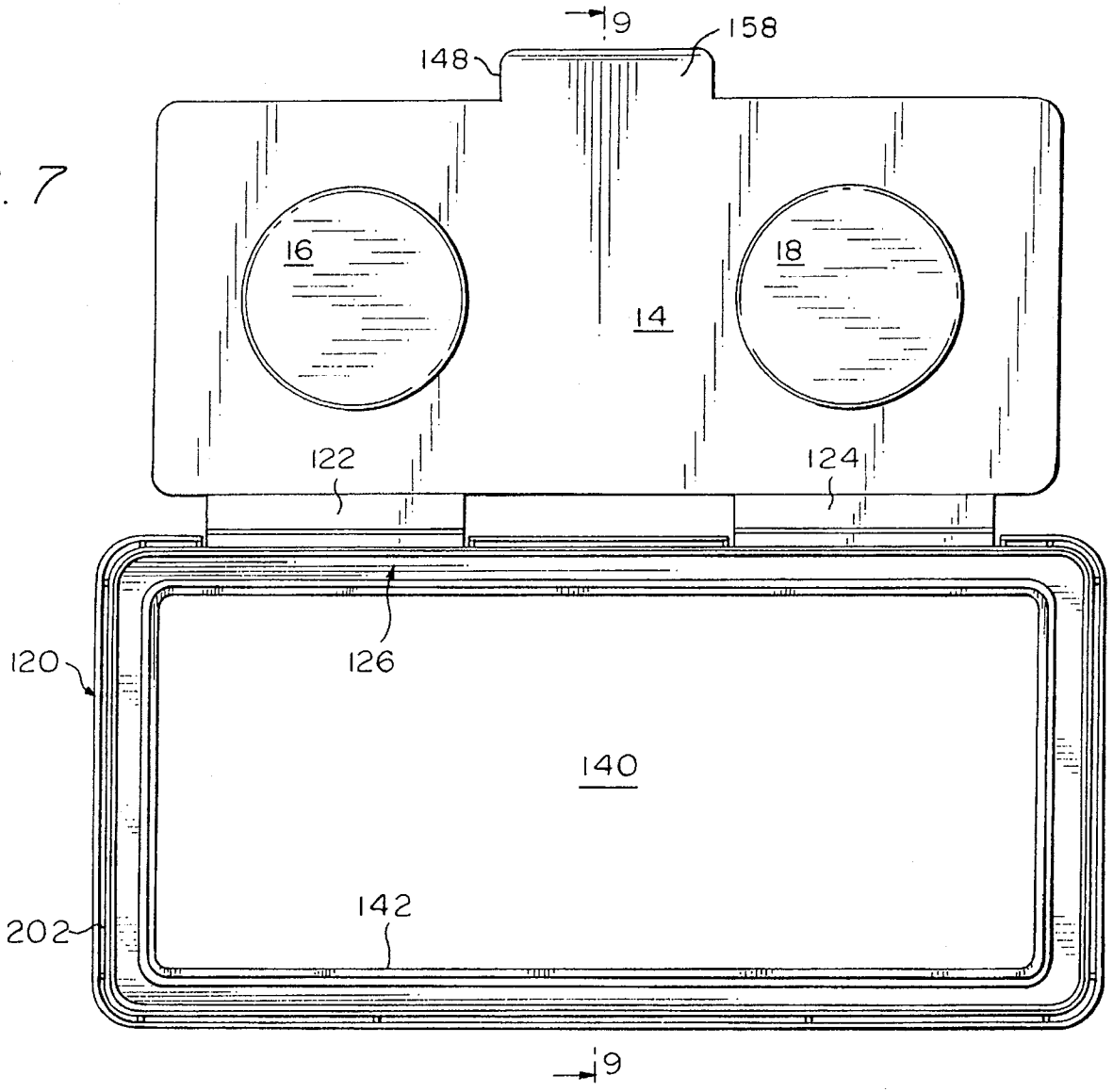
FIG. 7 is a planar view of one side of the unitary rim and lid structure in the lid-open mode.
Figure 8:
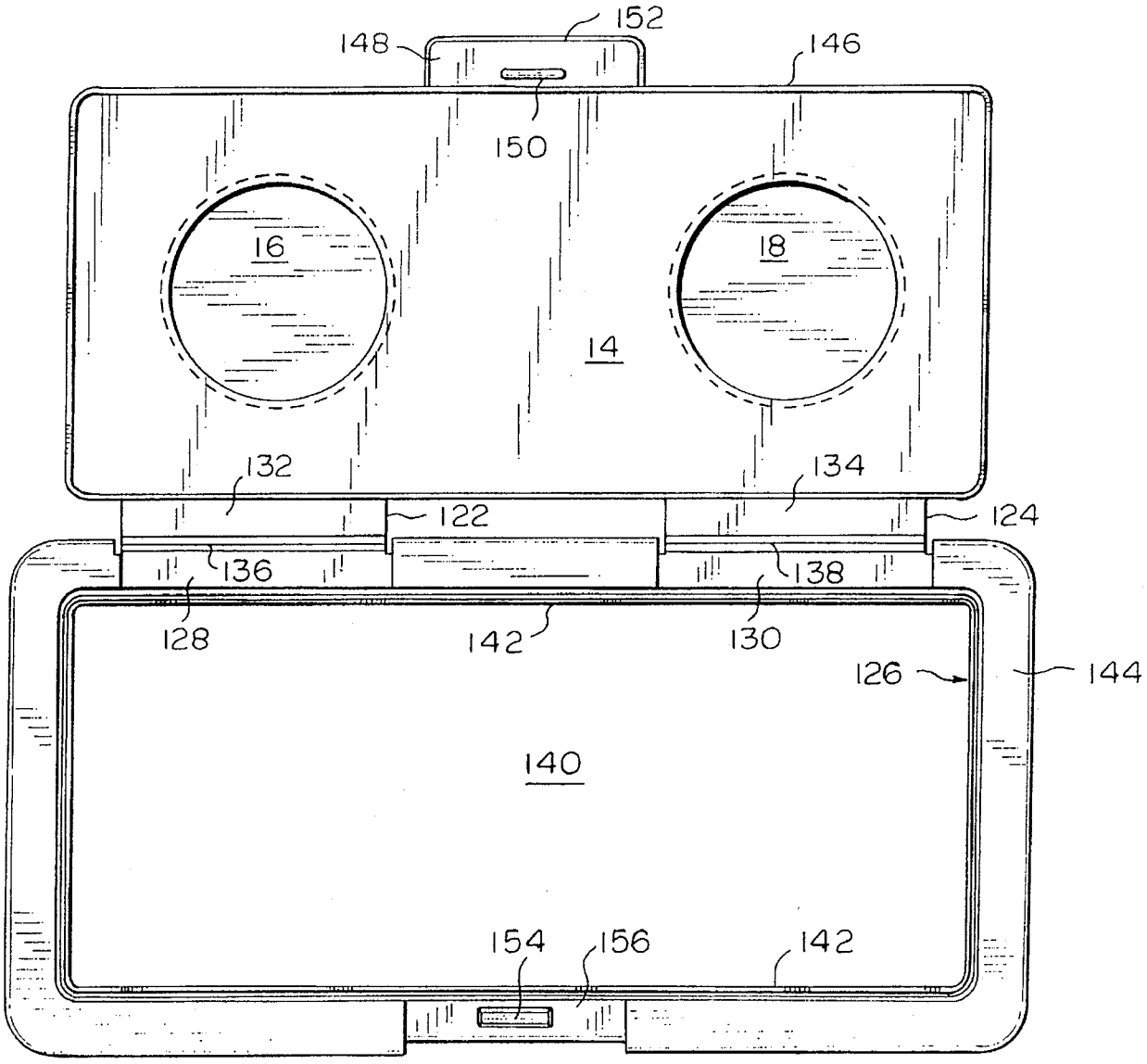
FIG. 8 is a planar view of the other side of the unitary rim and lid structure in the lid-open mode.
Figure 9:
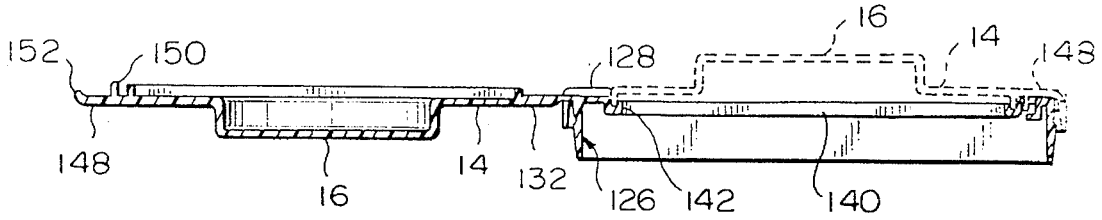
FIG. 9 is a side elevation, partially in phantom taken along lines 9—9 of FIGS. 7 and 8.

Referring now to FIGS. 7, 8, and 9, there is shown a top portion, designated generally by the numeral 120, of the container 10, wherein the lid 14 is secured by hinges in the form of webs 122 and 124 to a rim, designated generally by the numeral 126. As is best seen in FIG. 8, the rim 126 has two relieved portions or recesses, 128 and 130, which receive the leaves 132 and 134 of the hinges 122 and 124, respectively. Hinges 122 and 124 are living hinges which each have reduced thickness portions 136 and 138, which flex to allow the lid 14 to pivot over the rim 126 to assume the phantom line position shown in FIG. 9. When the lid 14 is in the closed position shown in phantom FIG. 9, it closes the opening 140 defined within the inner perimeter 142 of the rim 126. The relieved portions 128 and 130 of the rim 126 receive leaves 122 and 124 so as to be flush with the remaining upper surface 144 of the rim 126.

Figure 10:
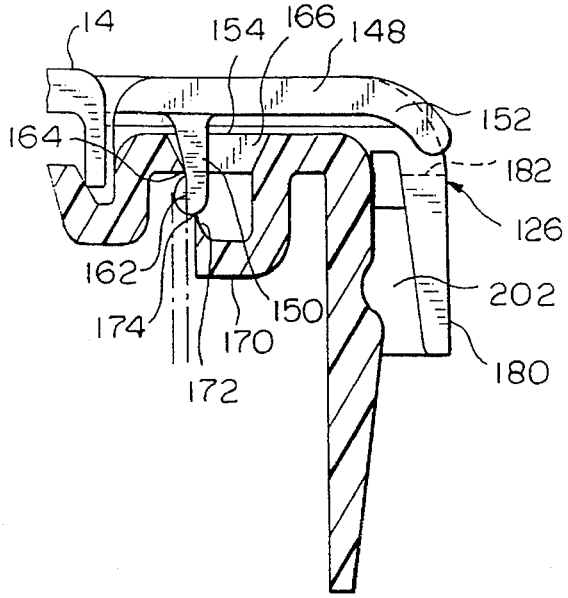
FIG. 10 is enlarged side elevation showing a latch engaged for latching the lid to the rim.

Depending from a front edge 146 of the lid 14 is a latch tab 148, which latch tab extends beyond the edge of the lid 14 by a distance substantially equal to the width of the rim 144 (see FIG. 10). The latch tab 148 includes a resilient detent 150, depended therefrom, and a downwardly extending finger tab portion 152. The detent 150 is received within a keeper slot 154 in a third relieved portion or recess 156 of the rim 126, so that the upper surface 158 of the latch 148 is flush with surface 144 of the rim 126.

Referring now more specifically to FIG. 10, where the latch tab 148 is shown in an enlarged view in its latched position, it is seen that the resilient detent 150 has an enlarged end 162. The enlarged end 162 of the resilient detent 150 is received beneath the lower edge 164 of the beveled side wall 166, defining the slot 154. A tang 170 disposed proximate the beveled wall 166 beneath the slot 154 has a projecting rib 172 with an edge 174 against which the bottom surface of the enlarged end 162 of the detent 152 presses. Rib 172 exerts a bias which urges the detent 152 against the lower edge 164 of the beveled slot wall 166, so as to provide an interference fit which retains the detent within the slot 154. The finger tab portion 152 projects slightly from a downwardly extending dependent skirt 180 and is accessible by a relieved portion 182 beneath the finger tab portion 152. As the finger tab 152 is lifted upwardly, the resilient detent 150 is pulled away from the edge 164 so that the lid 14 is liftable to the open position.

Figure 11:
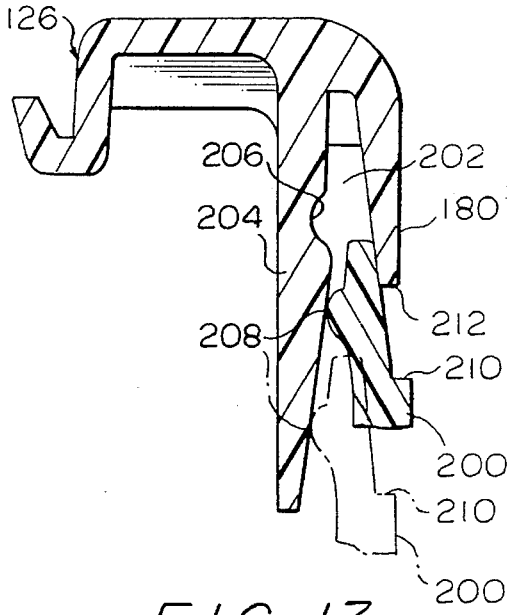
FIG. 11 is an enlarged elevation showing how the rim is coupled to a box portion of the container.
Figure 12:
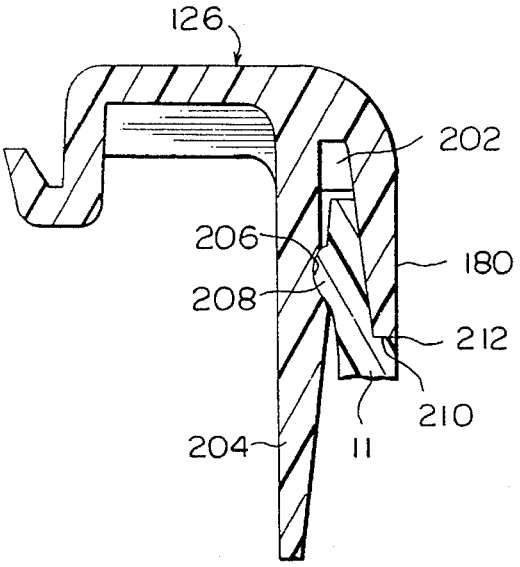
FIG. 12 is an elevation, similar to FIG. 11, but showing the rim coupled to the container.
Figure 13:
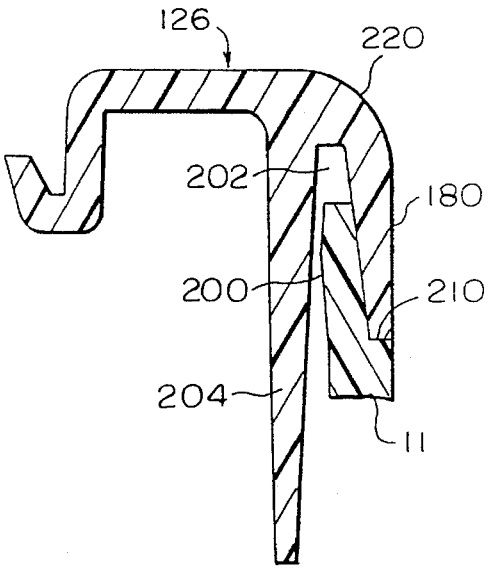
FIG. 13 is an elevation showing how the rim nests with the wall of the box portion at the corners of the container.

Referring now more specifically to FIGS. 11, 12 and 13, it is seen that the box portion 11 of the container 10 includes upper wall sections 200 which are received in slots 202, defined by an inner skirt 204, disposed in spaced relation to the outer skirt 180. The inner skirt 204 has a grove 206 therein which receives rounded ribs 208 on the inner surface of the wall 200 defining the box 11. The walls 200 each further have a land portion 210 upon which rests the lower edge 212 of the outer skirt 180, as is seen in FIG. 12.

As is seen in FIG. 13, the corner portions 220 of the rim 126 and the box portion 11 are different from the straight portions, shown in FIGS. 11 and 12, in that there is no grove 206 in the inner skirt 204, and no rounded rib 208 proximate the upper edge of wall 200.

In the preferred embodiment, the container 10 is substantially rectangular, with curved edges and corners. However, the front, rear, and side walls do exhibit a slight taper of about ¾° to facilitate manufacture of the container from polypropylene.

In a preferred embodiment, the container has a length of 8.6", a width of about 4.3", and a depth of about 4". By having a length which is twice the width, it is possible to build structures having adjacent containers 10 with lengths extending normal to one another. Preferred ranges of dimensions for the container 10 include a length of 7–9", a width of 3–5", and a depth of 3–5". A wall thickness of about 0.050" for the polypropylene forming the container 10 (including the rings 86 and 88) is sufficient to provide the container with necessary rigidity.

Without further elaboration, it is believed that one skilled in the art can, using the preceding description, utilize the present invention to its fullest extent.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In combination, a plurality of rectangular stackable containers of a substantially identical size and shape, each initially containing consumable materials in combination therewith, wherein each stackable container has a lid with projecting interlockable members only and a bottom with recessed interlockable members, only the interlockable members on each container being in alignment with one another and interlocking with interlockable members on adjacent stackable containers, each stackable container having a selected length and a selected width wherein the length is twice the width, each container being a stackable toy block when emptied of the materials which toy block selectively extends parallel to and perpendicular to adjacent toy blocks interlocked therewith in an array of staggered interconnected toy blocks.

2. The combination of claim 1 wherein the projecting interlockable members on the lid are a pair of projections and the recessed interlockable members on the bottom of the container comprise a pair of indentations.

3. The combination of claim 1, wherein the projections and recessed interlockable members are cylindrical.

4. The combination of claim 3, wherein the consumable materials are premoistened wipes.

5. In combination, a plurality of rectangular stackable containers of a substantially identical size and shape, each initially containing premoistened baby wipes in combination therewith, wherein each stackable container has a lid with projecting interlockable members only and a bottom with recessed interlockable members, only the interlockable members on each container being in alignment with one another and interlocking with interlockable members on adjacent stackable containers, each stackable container having a selected length and a selected width wherein the length is twice the width, each container being a stackable toy block when emptied of the materials which toy block selectively extends parallel to and perpendicular to adjacent toy blocks interlocked therewith in an array of staggered interconnected toy blocks.

6. The combination of claim 5, wherein there are only two projections and two recessed interlockable members on each container.

7. The combination of claim 6, wherein the projections and recessed interlockable members are cylindrical.

* * * * *